US005310125A

United States Patent [19]

Kitamura

[11] Patent Number: 5,310,125

[45] Date of Patent: May 10, 1994

[54] TRANSFORMER COIL WINDING APPARATUS FOR WINDING WIRE ON A COIL BOBBIN

[75] Inventor: Fumio Kitamura, Chino, Japan

[73] Assignee: Kitamura Kiden Co., Ltd., Nagano, Japan

[21] Appl. No.: 859,333

[22] Filed: Mar. 27, 1992

[30] Foreign Application Priority Data

Oct. 23, 1991 [JP] Japan ..... 3-275420

[51] Int. Cl.[5] ..... H01F 41/06; B65H 54/28

[52] U.S. Cl. ..... 242/7.15; 242/36

[58] Field of Search ..... 242/7.15, 7.14, 7.16, 242/4 B, 7.05 C, 36; 72/4; 140/92.2; 112/278; 139/452

[56] References Cited

U.S. PATENT DOCUMENTS

| | | | |
|---|---|---|---|
| 3,462,091 | 8/1969 | Adrien et al. | 242/7.15 |
| 4,022,391 | 5/1977 | Stein et al. | 242/7.15 X |
| 4,170,951 | 10/1979 | Dobrjanskyj | 112/278 |
| 4,184,644 | 1/1980 | Itoh et al. | 242/4 B |
| 4,244,539 | 1/1981 | Taneda et al. | 242/158 R |
| 4,848,135 | 7/1989 | Kumo . | |
| 5,029,619 | 7/1991 | Hongo et al. | 242/7.05 C X |
| 5,036,174 | 7/1991 | Iwasaki et al. | 242/36 |
| 5,080,295 | 1/1992 | Hongo et al. | 242/7.05 R X |

FOREIGN PATENT DOCUMENTS

| | | |
|---|---|---|
| 2830644 | 1/1980 | Fed. Rep. of Germany . |
| 3049404 | 7/1982 | Fed. Rep. of Germany . |
| 2124609 | 9/1972 | France . |
| 58-12426 | 9/1983 | Japan . |
| 687151 | 2/1953 | United Kingdom . |
| 2048137 | 12/1980 | United Kingdom . |

*Primary Examiner*—Andrew M. Falik

*Attorney, Agent, or Firm*—Merchant, Gould, Smith, Edell, Welter & Schmidt

[57] ABSTRACT

A transformer coil winding apparatus for winding a winding wire on a coil bobbin comprises a rotating drive mechanism for rotatably driving the coil bobbin by a friction force between the coil bobbin and the rotating drive mechanism. Further, the transformer coil winding apparatus comprises a detection unit provided on said coil bobbin, a rotation number counting unit for counting number of rotations of the coil bobbin on the basis of the output of the detection unit, and a drive unit for rotatably driving the rotating drive mechanism in response to the number of rotations on the rotation number counting unit. Therefore, the production cost for the transformer can be lowered.

27 Claims, 17 Drawing Sheets

TRANSFORMER COIL WINDING APPARATUS FOR WINDING WIRE ON A COIL BOBBIN

BACKGROUND OF THE INVENTION

1. Field of the Invention

The present invention relates to a transformer coil winding apparatus, more particularly, to a transformer coil winding apparatus for winding a winding wire on a coil bobbin to constitute a transformer.

2. Description of the Related Art

In the related art, a transformer, is for example, constituted by the way that a cylindrical coil bobbin is mounted to a non-cut iron core of essentially circular cross section, and the winding wire (coil) is wound by rotation of the coil bobbin. In this type of transformer, gear teeth are formed on the outer periphery of the coil bobbin to mesh with a gear of a drive shaft, whereby synchronization of a drive motor and the coil bobbin is established for accurately obtaining the number of turns of the winding wire unto the fraction.

Note, in the transformer coil winding apparatus according to the related art, when the winding wire is to be shifted laterally (traverse), the shifting magnitude is determined depending upon the diameter of the winding wire. Further, the diameter of the winding wire may fluctuate, and thus fine adjustment of a traverse operation cannot be obtained. Further, in the transformer coil winding apparatus of the related art, a reversal operation of the traverse shift is carried out by actuating the limit switch with the traverse unit when the winding wire (coil) abuts the flange at either side end of the coil bobbin.

In the transformer coil winding apparatus according to the related art, the gear teeth are formed on the outer periphery of the coil bobbin, and thus production cost for the coil bobbin becomes higher and the production cost of the transformer increases. Further, the rotational drive with meshed gear is not suitable for high speed rotation of the coil bobbin, and thus the meshed gear is not suitable for mass production to again cause a rise in the production cost of the transformer.

Furthermore, when the traverse shifting magnitude is determined depending upon the diameter of the winding wire, the actual winding wire diameter is not uniform to cause disturbance of the traverse shifting. In addition, when the reversal operation of traverse shift is carried out by actuating the limit switch with the traverse unit, as described above, even when the shifting magnitude of the traverse unit (traverse shifting magnitude) is adjusted to a predetermined speed, the reversal operation may occur before or after reaching the predetermined coil width, since the coil width is variable depending upon the diameter of the winding wire.

SUMMARY OF THE INVENTION

An object of the present invention is to provide a transformer coil winding apparatus having lower production cost of a transformer. Another object of the present invention is to provide stable traverse shifting of a wire while winding a wire on a coil bobbin. Further, a still another object of the invention is to stably perform reversal of the traverse shifting of the wire without performing fine adjustment of the position of the limit switch or fine adjustment of the shifting speed of the traverse unit associated with fluctuation of the diameter of the winding wire.

According to the present invention, there is provided a transformer coil winding apparatus for winding a winding wire on a coil bobbin comprising: a rotating drive mechanism for rotatably driving the coil bobbin by a friction force between the coil bobbin and the rotating drive mechanism.

The transformer coil winding apparatus may further comprise: a detection unit provided on the coil bobbin; a rotation number counting unit for counting number of rotations of the coil bobbin on the basis of the output of the detection unit; and a drive unit for rotatably driving the rotating drive mechanism in response to the number of rotations on the rotation number counting unit. The transformer coil winding apparatus may further comprise: a detection unit provided on the coil bobbin; a rotation number counting unit for counting number of rotations of the coil bobbin on the basis of the output of the detection unit; and a winding traversing unit for maintaining a winding angle of the winding wire at a predetermined value in response to the number of rotations on the rotation number counting unit.

The transformer coil winding apparatus may further comprise: a detection unit provided on the coil bobbin; a rotation number counting unit for counting number of rotations of the coil bobbin on the basis of the output of the detection unit; a rotary encoder provided on a drive shaft of the rotating drive mechanism; and a drive unit for rotatably driving the rotating drive mechanism in response to the number of rotations on the rotation number counting unit and the output of the rotary encoder. The transformer coil winding apparatus may further comprise: a memory unit for storing number of outputs per one cycle of the rotary encoder in detection period for detecting one cycle of the coil bobbin by the rotation number counting unit; and inhibiting unit for inhibiting incrementing of rotations on the rotation number counting unit when number of outputs or output value of the rotary encoder upon reception of the output signal of the detection unit is smaller than a value smaller than the output number or the output value per one cycle. The transformer coil winding apparatus may further comprise: a memory unit for storing number of outputs per one cycle of the rotary encoder in detection period for detecting one cycle of the coil bobbin by the rotation number counting unit; and rotation number correction unit for incrementing of rotations on the rotation number counting unit by one when number of outputs or output value of the rotary encoder upon reception of the output signal of the detection unit is greater than a value greater than the output number or the output value per one cycle.

The transformer coil winding apparatus may further comprise: a detection unit provided on the coil bobbin; a rotation number counting unit for counting number of rotations of the coil bobbin on the basis of the output of the detection unit; a rotary encoder provided on a drive shaft of the rotating drive mechanism; and a winding traversing unit for maintaining a winding angle of the winding wire at a predetermined value in response to the number of rotations on the rotation number counting unit and the output of the rotary encoder.

The winding traversing unit may comprise: a winding angle sensor for detecting the winding angle of the winding wire; and a winding traverse shifting unit for maintaining the detected winding angle to a predetermined value. The transformer coil winding apparatus may include: a winding angle abrupt variation judgement unit for judgement of abrupt variation of the detected winding angle; and a reversing unit for reversing the winding angle by the winding traverse shifting unit when the detected winding angle is abruptly varied.

Further, according to the present invention, there is also provided a coil bobbin for a transformer where a winding wire is wound by using a transformer coil winding apparatus with rotatably driving the coil bobbin by a friction force between the coil bobbin and a rotating drive mechanism of the transformer coil winding apparatus, wherein the coil bobbin comprises: a detection unit for counting number of rotations of the coil bobbin by a rotation number counting unit, and the coil bobbin being rotatably driven by the rotating drive mechanism in response to the number of rotations on the rotation number counting unit.

The coil bobbin may comprise two flanges, and the detection unit may comprise at least one optical marks provided on one of the flanges of the coil bobbin and an optical sensor for detecting the optical marks by one cycle of rotation of the coil bobbin. Each of the optical marks may have a different light reflection factor from another area of the flange where the optical marks are not provided, and the optical sensor may detect the light intensity reflected from the optical marks. Each of the optical marks may have a specific color different from another area of the flange where the optical marks are not provided, and the optical sensor may detect the color of the optical marks.

The coil bobbin may comprise two flanges made of dielectric material, and the detection unit comprises at least one metal marks provided on one of the flanges of the coil bobbin and a metal sensor for detecting the metal marks by one cycle of rotation of the coil bobbin.

BRIEF DESCRIPTION OF THE DRAWINGS

The present invention will be more clearly understood from the description of the preferred embodiments as set forth below with reference to the accompanying drawings, wherein.

DESCRIPTION OF THE PREFERRED EMBODIMENTS

For a better understanding of the preferred embodiments, first, the problems of the related art will be explained, with reference to FIGS. 1 and 2.

In a transformer coil winding apparatus of the related art, a cylindrical coil bobbin is mounted to a non-cut iron core of essentially circular cross section, and the coil (winding wire) is wound by rotation of the coil bobbin.

Figure 1:
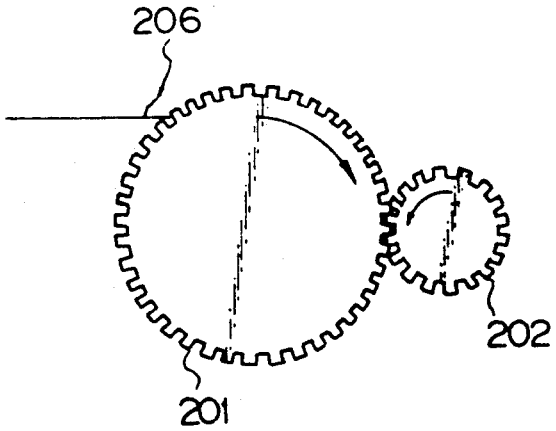
Fig. 1 PRIOR ART
FIG. 1 is a schematic view showing an example of a coil bobbin and driving mechanism according to the related art.
Figure 2A:
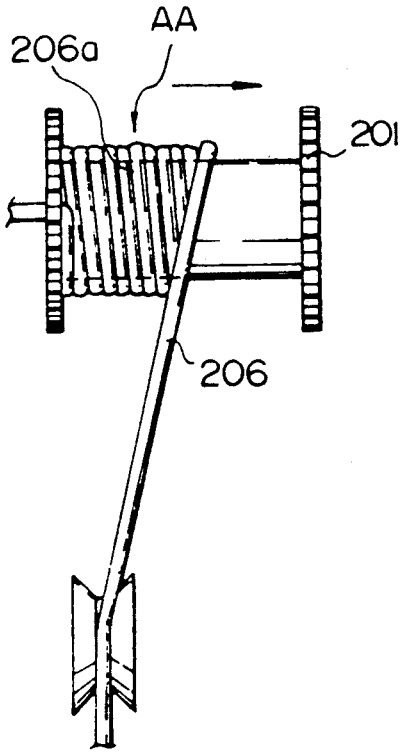
FIGS. 2A and 2B are plan views of a coil bobbin for explaining problems in the related art.
Figure 2B:
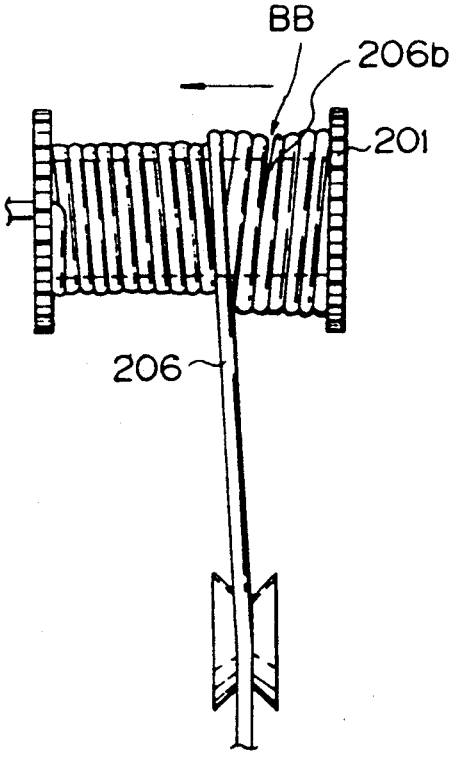

FIG. 1 shows an example of a coil bobbin and driving mechanism according to the related art, and FIGS. 2A and 2B respectively show a coil bobbin for explaining problems in the related art. In FIGS. 1, 2A and 2B, reference numeral 201 denotes a coil bobbin, 202 denotes a drive shaft, and 206 denotes a winding wire (coil).

As shown in FIG. 1, in the transformer coil winding apparatus of the related art, gear teeth are formed on the outer periphery of the coil bobbin 201 to mesh with a gear of the drive shaft 202, and whereby synchronization of a drive motor and the coil bobbin 201 is established for accurately obtaining the number of turns of the coil unto the fraction. For example, even when the winding start position and the winding end position are offset for $\frac{1}{4}$ turn or $\frac{1}{2}$ turn, the number of turns of the winding can be accurately obtained up to the fractions of $\frac{1}{4}$ and $\frac{1}{2}$.

Further, in the transformer coil winding apparatus of the related art, when the winding wire (coil) 206 is to be shifted laterally (traverse), the shifting magnitude is determined depending upon the diameter of the winding wire 206. Note, the diameter of the winding wire 206 may be fluctuated or shifted about ±20%. In the transformer coil winding apparatus of the related art, a trial winding operation is carried out for fine adjustment of the traverse shifting magnitude so as to obtain an appropriate winding angle, but the fine adjustment cannot be obtained by the diameter fluctuation of the winding wire 206.

As clearly as shown in FIG. 2A, when the diameter of the winding wire 206 is large at an area 206*a*, the corresponding portion AA of the winding wire (coil) 206 becomes thick. Namely, when the diameter of the winding wire 206 is large, the width of the coil at the portion AA becomes long. Therefore, the following winding operation for winding the wire 206 onto the portion AA cannot be orderly or correctly carried out, so that the produced transformer is rendered an inferior transformer.

On the other hand, as shown in FIG. 2B, when the diameter of the winding wire 206 is small at an area 206*b*, the corresponding portion BB of the winding wire 206 also becomes thin. Namely, when the diameter of the winding wire 206 is small, the width of the coil at the portion BB becomes short. Therefore, the following winding operation for winding the wire 206 onto the portion BB cannot be orderly or correctly carried out, so that the produced transformer is rendered an inferior transformer.

Further, in the transformer coil winding apparatus according to the related art, a reversal operation of the traverse shift is carried out by actuating the limit switch with the traverse unit, when the coil (winding wire) 206 abuts the flange at either side end of the coil bobbin 201. Nevertheless, in the transformer coil winding apparatus of the related art, the gear teeth are formed on the outer periphery of the coil bobbin 201, and thus production cost for the coil bobbin 201 becomes higher and thereby the production cost of the transformer is increased. Further, the rotational drive with a meshed gear is not suitable for high speed rotation of the coil bobbin, and thus the meshed gear is not suitable for mass production to again cause a rise in the production cost of the transformer.

Note, as described above with reference to FIGS. 2A and 2B, when the traverse shifting magnitude is determined depending upon the diameter of the winding wire, the actual winding wire diameter is not uniform to cause a disturbance of the traverse shifting. This cannot be compensated by fine adjustment during trial winding. Further, when the reversal of traverse shift is carried out by actuating the limit switch with the traverse unit, as described above, even when the shifting magnitude of the traverse unit (traverse shifting magnitude) is adjusted to a predetermined speed, it is possible that the reversal will occur before or after reaching the predetermined coil width since the coil width is variable depending upon the diameter of the winding wire. To avoid this, it becomes necessary to frequently perform a fine adjustment of the position of the limit switch or shifting speed of the traverse unit.

Below, the preferred embodiments of a transformer coil winding apparatus according to the present invention will be explained with reference to the accompanying drawings.

Figure 3:
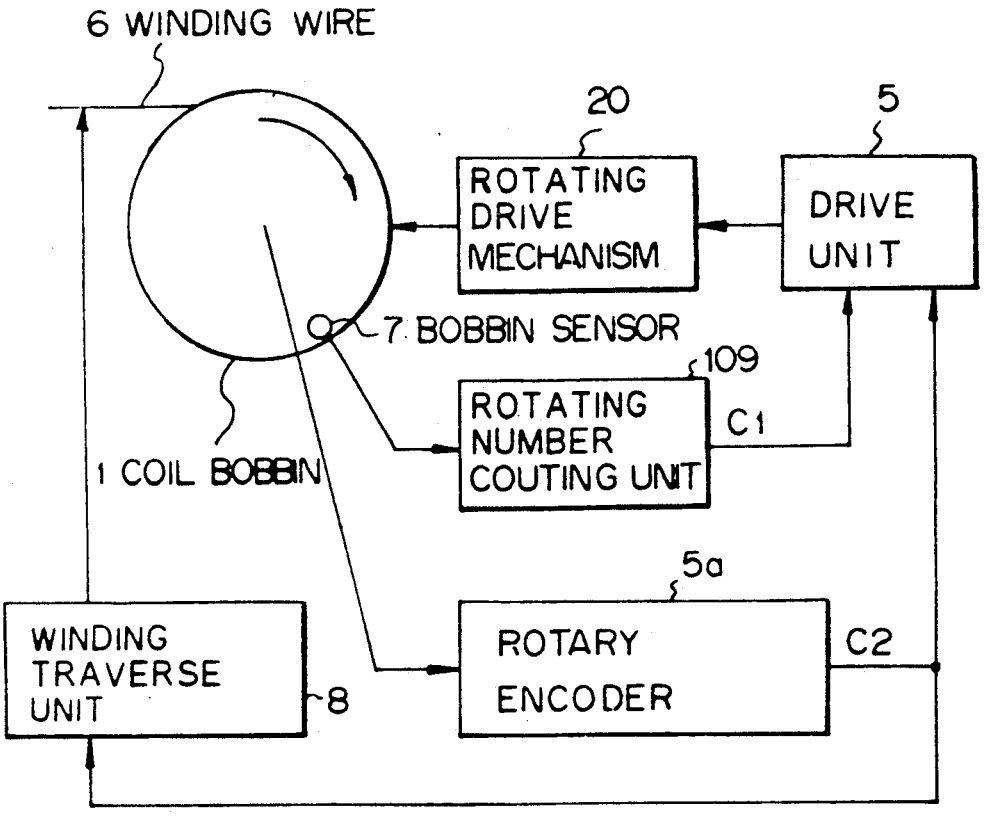
FIG. 3 is a block diagram showing the basic construction of a transformer coil winding apparatus according to the present invention.

FIG. 3 is a block diagram showing the basic construction of a transformer coil winding apparatus according to the present invention. In FIG. 3, reference numeral 1 denotes a coil bobbin, 6 denotes a winding wire (coil), and 7 denotes a bobbin sensor. Further, reference numeral 5 denotes a drive unit, 8 denotes a traverse unit, 20 denotes a rotating drive mechanism, 109 denotes a rotating number counting unit, and 5*a* denotes rotary encoder.

As shown in FIG. 3, in the transformer coil winding apparatus for winding the coil (winding wire) 6 on the coil bobbin 1, the rotating drive mechanism 20 rotatably drives the coil bobbin 1 with the friction force. Further, the detection unit for the coil bobbin (bobbin sensor) 7 is provided for the coil bobbin 1. Note, the rotating number counting unit 109 counts the number of rotations C1 of the coil bobbin 1 on the basis of the output of the detection unit 7.

Further, the rotary encoder 5*a* is, for example, provided on the drive shaft of the rotating drive mechanism 20. The drive unit 5 drives the rotating drive mechanism 20 to rotate according to the number of rotations C1 oN the rotating number counting unit 109 and the output C2 of the rotary encoder 5*a*. Note, the winding traverse unit 8 maintains the winding angle of the wire (coil) 6 at a predetermined value. Namely, the winding traverse unit 8 maintains the winding angle of the wire 6 at a predetermined value depending upon the output of the rotary encoder 5*a*, or in the alternative, the winding angle of the wire 6 is maintained at a predetermined value depending upon the output of a winding angle sensor that detects the winding angle of the wire 6 and is described later in detail.

In the above transformer coil winding apparatus, by employment of a friction drive, the gear teeth cannot be formed on the outer periphery of the coil bobbin 1, and only the detecting unit (bobbin sensor) 7 is provided for the coil bobbin 1. Therefore, high accuracy is not required for the coil bobbin 1, and thus the production cost can be lowered. Further, because there is no rotating drive with the meshing of a gear, a high speed rotation operation of the coil bobbin 1 can be obtained, and mass production can be realized.

Further, even when synchronizing between the coil bobbin 1 and the drive shaft is lowered, detection of the accurate number of turns of the coil (winding wire) 6 can be made by the number of rotations of the coil bobbin 1 and the output of the rotary encoder 5*a*. Furthermore, with the output of the rotary encoder 5*a* or the output of the winding angle sensor, the winding angle can be stably maintained.

Figure 4:
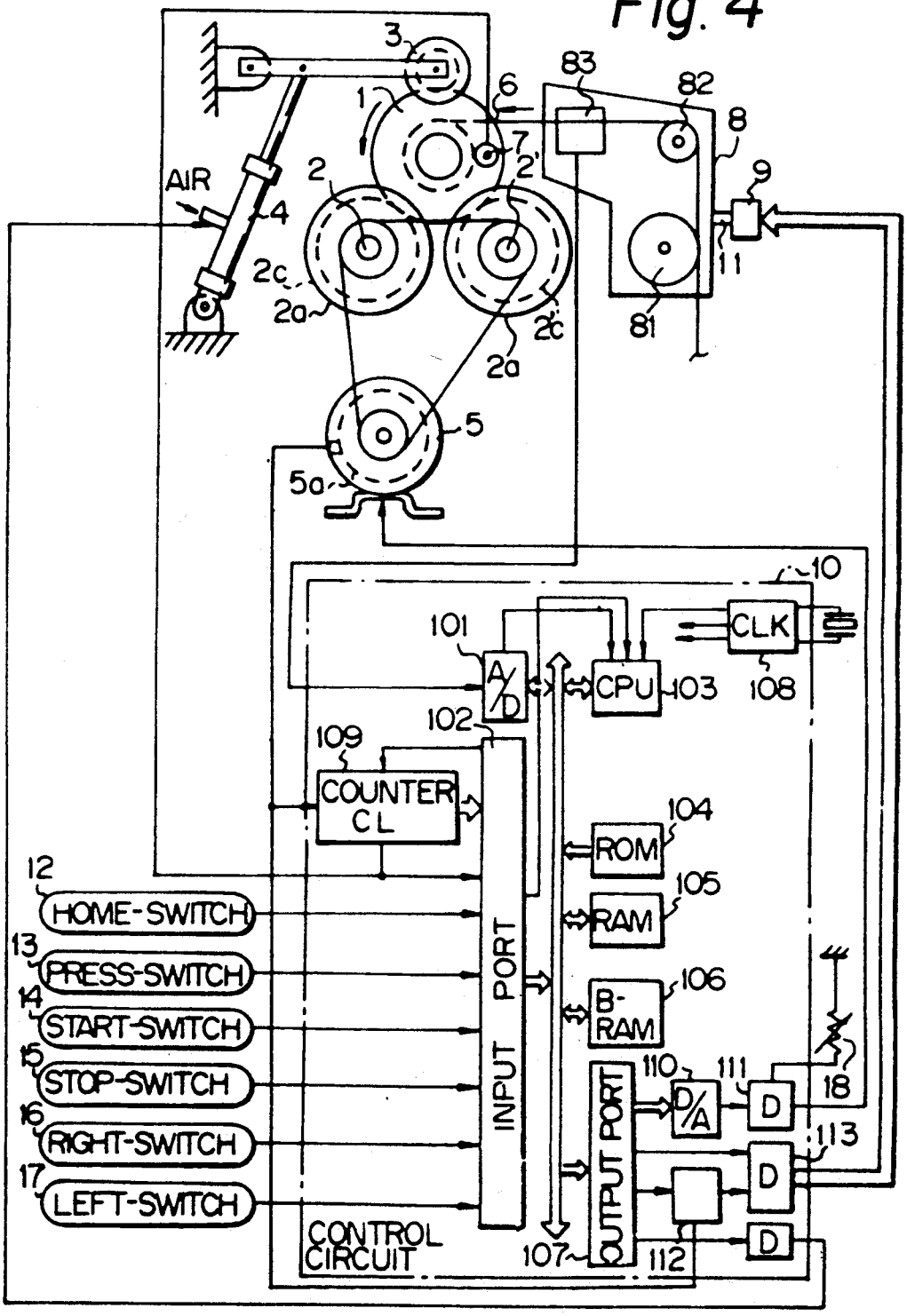
FIG. 4 is an elevational view showing an embodiment of a transformer coil winding apparatus according to the present invention.
Figure 5:
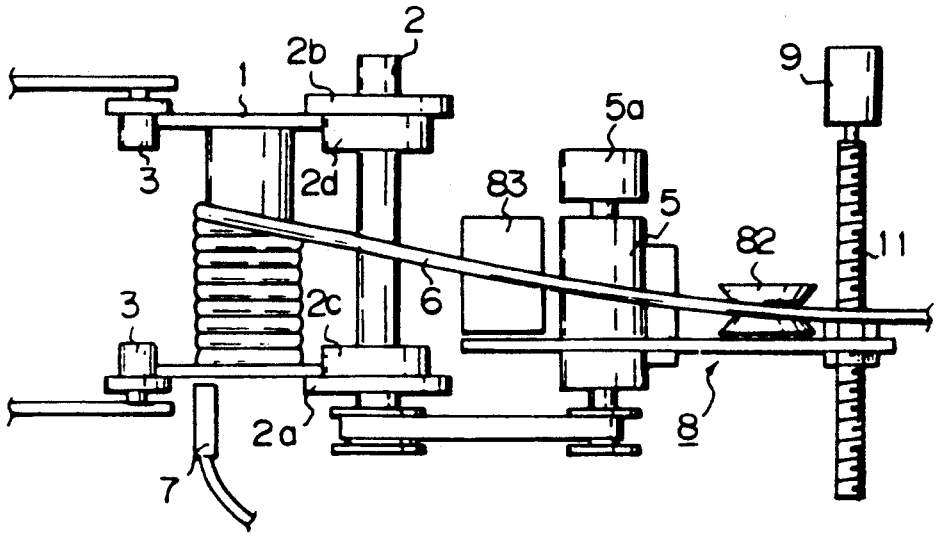
FIG. 5 is a plan view of the transformer coil winding apparatus shown in FIG. 4.

FIG. 4 shows an embodiment of a transformer coil winding apparatus according to the present invention, and FIG. 5 shows a plan view of the transformer coil winding apparatus of FIG. 4.

In FIGS. 4 and 5, a coil bobbin 1 is mounted between two pairs of bobbin drive rubber rollers 2*a*, 2*b*; 2*c*, 2*d* and 2'*a*, 2'*b*; 2'*c*, 2'*d* which are opposed on a pair of main shafts 2 and 2' at appropriate intervals. Further, the coil bobbin 1 is pressed by a pair of bobbin retainer rollers 3 from the above. Note, motion of the bobbin retainer rollers 3 in an up and down direction can be carried out by a pneumatic cylinder 4. Namely, when the bobbin retainer rollers 3 are lowered, an appropriate friction force is generated between the coil bobbin 1 and the bobbin drive rubber rollers 2*a* to 2*d* and 2'*a* to 2'*d* by the pressure of the pneumatic cylinder 4.

The main shafts 2 and 2' are driven by a main shaft driving spindle motor 5 which incorporates an incremental type rotary encoder 5*a*, and the coil bobbin 1 is driven to rotate and wind the winding wire thereon.

Note, a traverse unit 8 including a torque control device (not shown) for providing an appropriate tension for the coil is provided for the transformer coil winding apparatus.

Figure 6A:
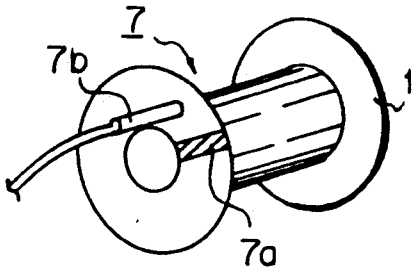
FIGS. 6A to 6C are perspective views showing examples of the coil bobbin applying to the transformer coil winding apparatus of the present invention.
Figure 6B:
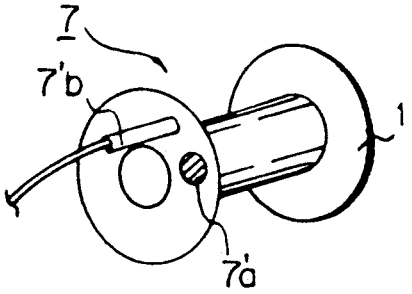
Figure 6C:
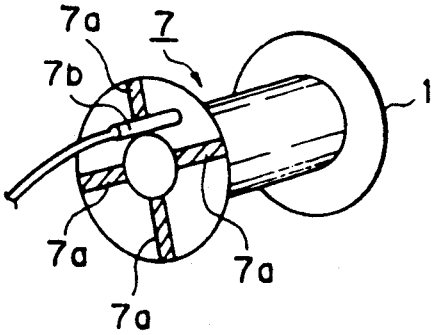

FIGS. 6A to 6C show examples of the coil bobbin applying to the transformer coil winding apparatus of the present invention.

As shown in FIGS. 6A and 6B, a bobbin sensor 7 is provided for the coil bobbin 1 to detect one cycle of rotation of the coil bobbin 1. Note, the coil bobbin 1 comprises two flanges, and these flanges (or coil bobbin 1) are made of dielectric material, such as a plastic.

Concretely, as shown in FIG. 6A, the bobbin sensor 7 comprises an optical mark 7*a* provided on one of the flanges of the coil bobbin 1 and an optical sensor 7*b*. Note, the optical sensor 7*b* is fixed on the transformer coil winding apparatus and is used to detect the optical mark 7*a* by one cycle of rotation of the coil bobbin 1. In this case, for example, the optical mark 7*a* is formed by a black mark, and the flanges are formed by a white (or light color) coil bobbin, so that the optical sensor 7*b* can detect the optical mark 7*a* by the reflection light intensity between the optical mark 7*a* (small reflection light intensity) and another area (large reflection light intensity) of the flange where the optical mark 7*a* is not provided. Note, the optical mark 7*a* can be formed by a white mark, and the flanges can be formed by a black (or dark color) coil bobbin.

Further, the optical mark 7*a* can be also formed by a specific color mark, for example, red or blue color marks. In this case, another area of the flange where the optical mark 7*a* is not provided is formed by another color, for example, green or yellow colors. Further, the optical sensor 7*b* can sense the difference between the colors between the color mark 7*a* (for example, a red portion) and another area of the flange (for example, a green area). Therefore, the optical sensor 7*b* can detect the optical mark 7*a* by one cycle of rotation of the coil bobbin 1.

On the other hand, as shown in FIG. 6B, the bobbin sensor 7 comprises a metal mark 7'*a* provided on one of the flanges of the coil bobbin 1 and a metal sensor 7'*b*. Note, the metal sensor 7'*b* is fixed on the transformer coil winding apparatus and is used to detect the metal mark 7'*a* by one cycle of rotation of the coil bobbin 1. Note, the metal mark 7'*a* is formed by a metal film for adhering on the flange of the coil bobbin 1 or a metal piece for fitting into the flange of the coil bobbin 1. Further, the metal sensor 7'*b* is, for example, a magnet sensor for enabling to detect the metal mark. In this case, a sensitive of the metal sensor 7'*b* is specified to a low value, or the fixed portion of the metal sensor 7'*b* is located at some distance from the coil bobbin 1, to avoid an erroneous detection of the winding wire (metal wire) 6 which is wound on the coil bobbin 1. Therefore, the metal sensor 7'*b* can detect the metal mark 7'*a* by one cycle of rotation of the coil bobbin 1.

Further, as shown in FIG. 6C, four optical marks 7*a* are provided on the flange of the coil bobbin 1 as a plural. Namely, the optical mark 7*a* provided on the flange (with reference to FIG. 6A) is not limited by one, but a plurality of optical marks 7*a* can be provided on the flange. In this case, the optical sensor 7*b* detects four optical marks 7*a* per one cycle of the coil bobbin 1. Similarly, the metal mark 7'*a* provided on the flange (with reference to FIG. 6B) is not limited by one, but a plurality of metal marks 7'*a* can be also provided on the flange.

As described above, at least one optical marks 7*a* or at least one metal marks 7'*a* can be provided on the the flange of the coil bobbin 1. In this case, a plural numbers corresponding to the optical marks 7*a* or the metal marks 7'*a* are detected by each one rotation cycle of the coil bobbin 1. Further, as shown in FIGS. 6A to 6C, the optical mark 7*a* is formed as a rectangular shape, and the metal mark 7'*a* is formed as a circle shape, but the shapes of the marks 7*a* and 7'*a* are not limited by the rectangular and circle shapes and can be formed as various shapes.

Figure 7:
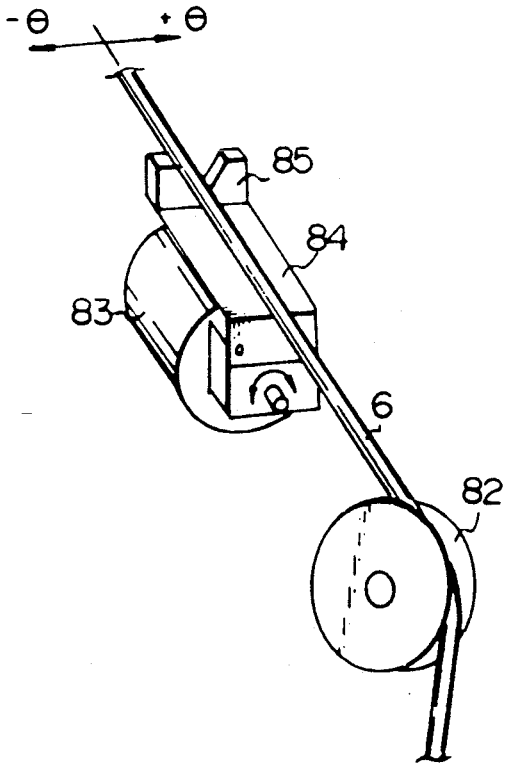
FIG. 7 is a perspective view of an example of a winding angle sensor applying to the transformer coil winding apparatus of the present invention.

FIG. 7 shows a perspective view of an example of a winding angle sensor applying to the transformer coil winding apparatus of the present invention. As shown in FIGS. 4, 5 and 7, the traverse unit 8 includes a tension wheel 81 (which is shown in FIG. 4) controlled by the torque control device, a reference roller 82 and a winding angle sensor 83 for detecting the winding angle of the winding wire 6. As shown in FIG. 5, the reference roller 82 and the winding angle sensor 83 are driven by a ball screw 11 with a traverse drive motor (stepping motor) 9. Therefore, alignment winding to wind the winding wire for each layer, can be carried out.

As shown in FIG. 7, a leaf spring 84 is provided on the shaft of the winding angle sensor 83, and a winding wire guide chip 85 having a V-shaped groove is provided at the tip end. The winding wire 6 extends through the V-shaped groove of the reference roller 82 and further through the V-shaped groove of the guide chip 85, and then the winding wire 6 is supplied to the coil bobbin 1.

Figure 8A:
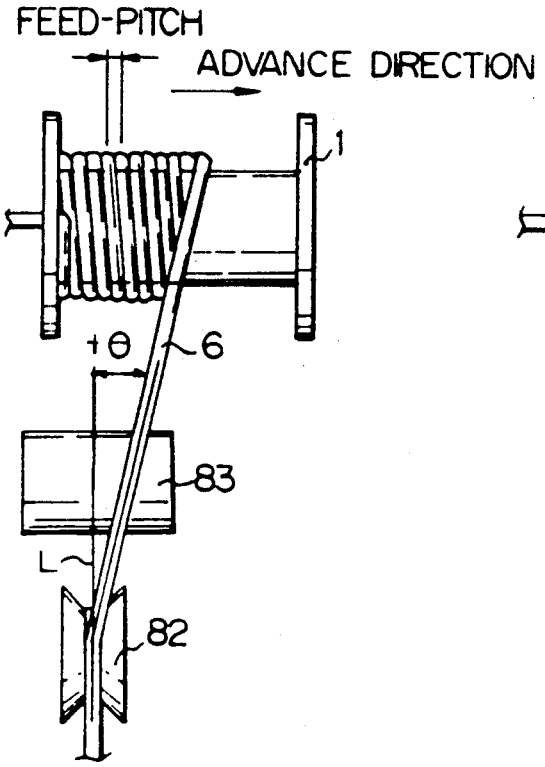
FIGS. 8A and 8B are plan views of a coil bobbin for explaining operations of the traverse unit applying to the transformer coil winding apparatus of the present invention.
Figure 8B:
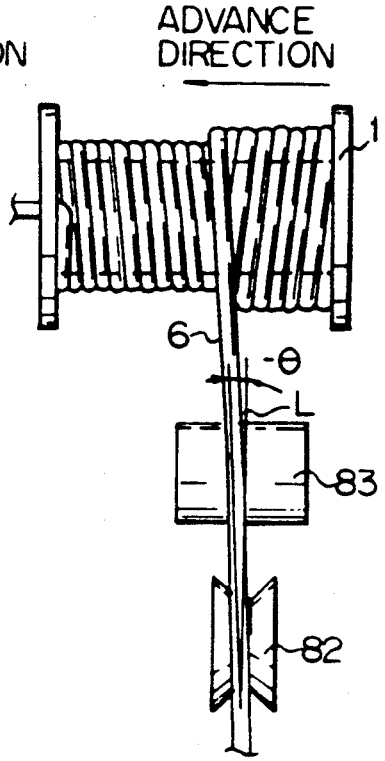

FIGS. 8A and 8B show plan views of a coil bobbin for explaining operations of the traverse unit applying to the transformer coil winding apparatus of the present invention. Note, when the feed speed of the traverse unit 8 and the winding speed of the winding wire 6 onto the coil bobbin 1 become inconsistent with each other, the winding wire 6 becomes, as shown in FIGS. 8A and 8B, oriented with respect to the line L defined by the center of the reference roller 82 and the axial center of the winding angle sensor 83, in angle $+\Theta$ (FIG. 8A) or $-\Theta$ (FIG. 8B). At this time, the winding angle sensor 83 desirably has small frictional resistance against rotation and a large output. It is also desirably small and inexpensive. For example, the winding angle sensor which employs a non-linear type magnetic resistance element, can be used.

Next, processes of a control circuit (microcomputer) 10 of FIG. 4 will be explained.

As shown in FIG. 4, the control circuit 10 includes an A/D converter 101, an input port 102, a central processing unit (CPU) 103, a ROM 104, a RAM 105, a back-up RAM (b-RAM) 106, an output port 107, and a clock generator 108.

The A/D converter 101 receives the output of the winding angle sensor 83. The output of the counter 109 is input to the input port 102. The counter 109 is designed for counting the pulse of the incremental type rotary encoder 5*a* and is cleared by the output of the bobbin sensor 7, namely every one cycle of rotation of the coil bobbin 1. Further, the counter 109 is also cleared by the CPU 103 as described later.

The input port 102 receives the output of the bobbin sensor 7, and signals from various switches on a control panel, such as a home-switch 12, a press-switch 13, a start-switch 14, a stop-switch 15, a rightward traverse switch (right-switch) 16, a leftward traverse switch (left-switch) 17, and the like.

The ROM 104 previously stores the latter described programs, constants and the like, and the RAM 105 also temporarily stores data. Further, in the back-up RAM 106, which is directly connected to a battery (not shown), re-writable data is stored in a non-volatile fashion. For example, in the back-up RAM 106, data of the code numbers of respective used bobbins, number of coils, number of turns to wind for each coil, winding wire diameter (in this case, nominal wire diameter, winding start portion, winding end position, slow start winding number for winding over which winding is to be carried out at low speed, ratio relative to the maximum speed for winding at low speed at both ends of the coil bobbin (%), the reversal angular variation ($\Theta_{min}$) at both ends of the bobbin, the holding winding angle ($\Theta_R$), degree of slowing down at stopping, commend and so forth, are stored. Namely, upon the winding operation, by accessing the code number, the electrical condition for the corresponding winding can be set.

As shown in FIG. 4, a D/A converter 110 commanding the speed of the main shaft spindle motor 5 and a driver circuit 111 for the main shaft spindle motor 5 are connected to the output port 107. The driver circuit 111 includes a comparator for comparing the output of the D/A converter 110 and a voltage determined by a variable resistor 18 which sets a maximum speed. When the output of the D/A converter 110 is smaller than the maximum speed value, the main shaft spindle motor 5 is driven at a steep corresponding to the output of the D/A converter 110. On the other hand, when the output of the D/A converter 110 is greater than the maximum speed value, the main shaft spindle motor 5 is driven at a speed of the maximum speed value.

Further, the output port 107 is also connected to a rate generator 112 which generates one pulse per given number of pulses of the incremental type rotary encoder 5*a*, and a driver circuit 113. The given number of pulses is preliminary set in the rate generator 112 by the CPU 103. The driver circuit 113 drives the stepping motor 9 in left hand direction or in the right hand direction depending upon the number of pulses from the rate generator 112 in response to the rotating direction command signal from the output port 107. The operation of the rate generator 112 can be done by software.

Note, interruption of the CPU 103 is taken place at a timing after A/D conversion of the A/D converter 101, upon reception of the output of the bobbin sensor 7, a predetermined time interval of the clock generator circuit 107, e.g., upon receipt of a pulse signal every 4 ms. For example, the bobbin sensor 7 generates one pulse per every one cycle of rotation of the coil bobbin 1.

Below, the operations of the control circuit of FIG. 4 will be described. Note, in advance of initiating (turning ON) operation of the control circuit 10, preparation is carried out for setting mechanical conditions, such as the widths of the bobbin driving rubber rollers corresponding to the dimension of the coil bobbin, setting the pressure for the bobbin retainer roller 3, adjustment of an angle of a core receptacle, setting of the winding wire, setting of the torque of the torque control device, setting of variable resistor for the maximum speed of the main shaft 2, 2'.

Figures 1, 10:
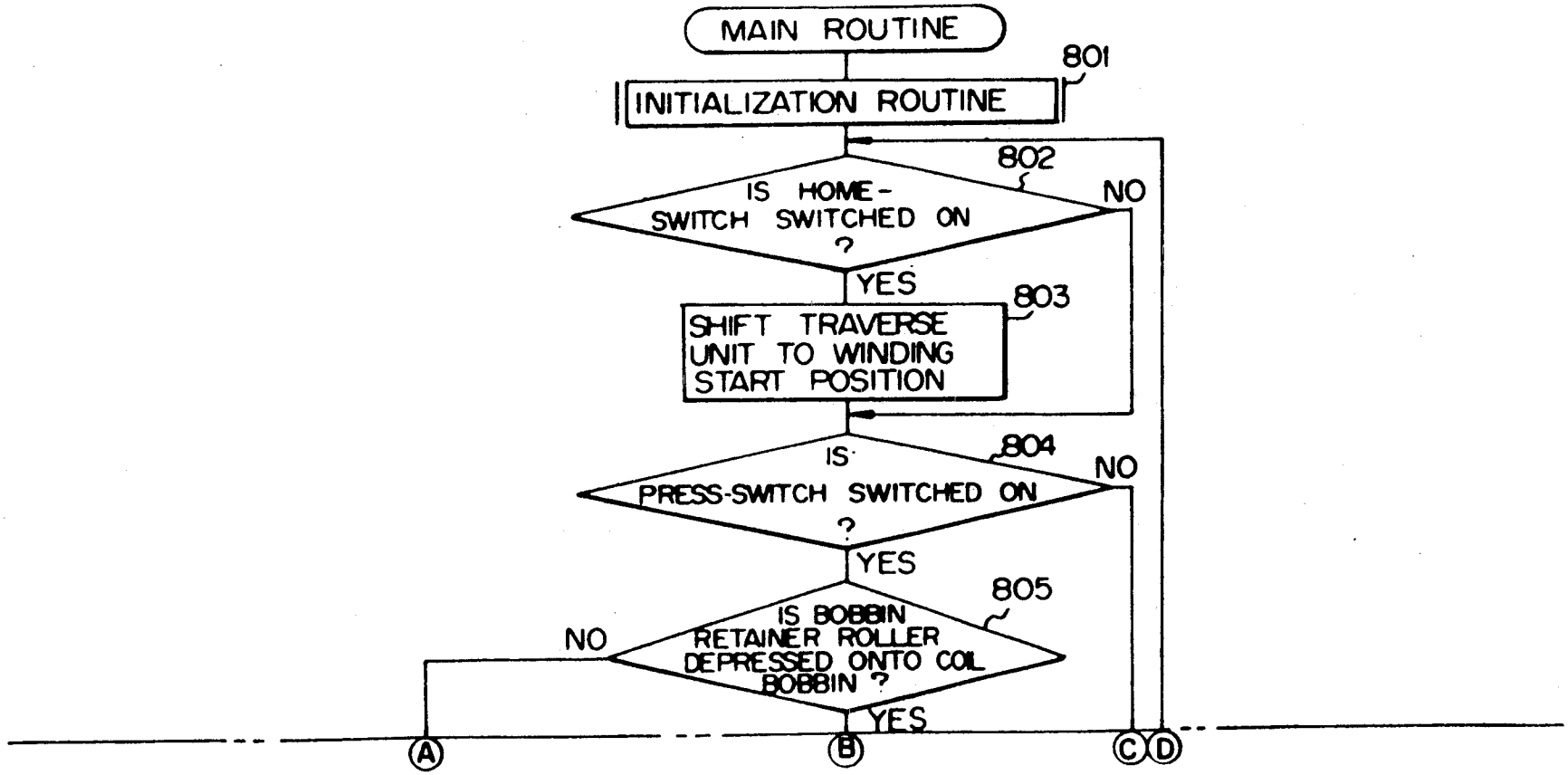
FIGS. 10 to 17 are flowcharts showing operations of the control circuit of the transformer coil winding apparatus according to the present invention.
Figures 2, 10:
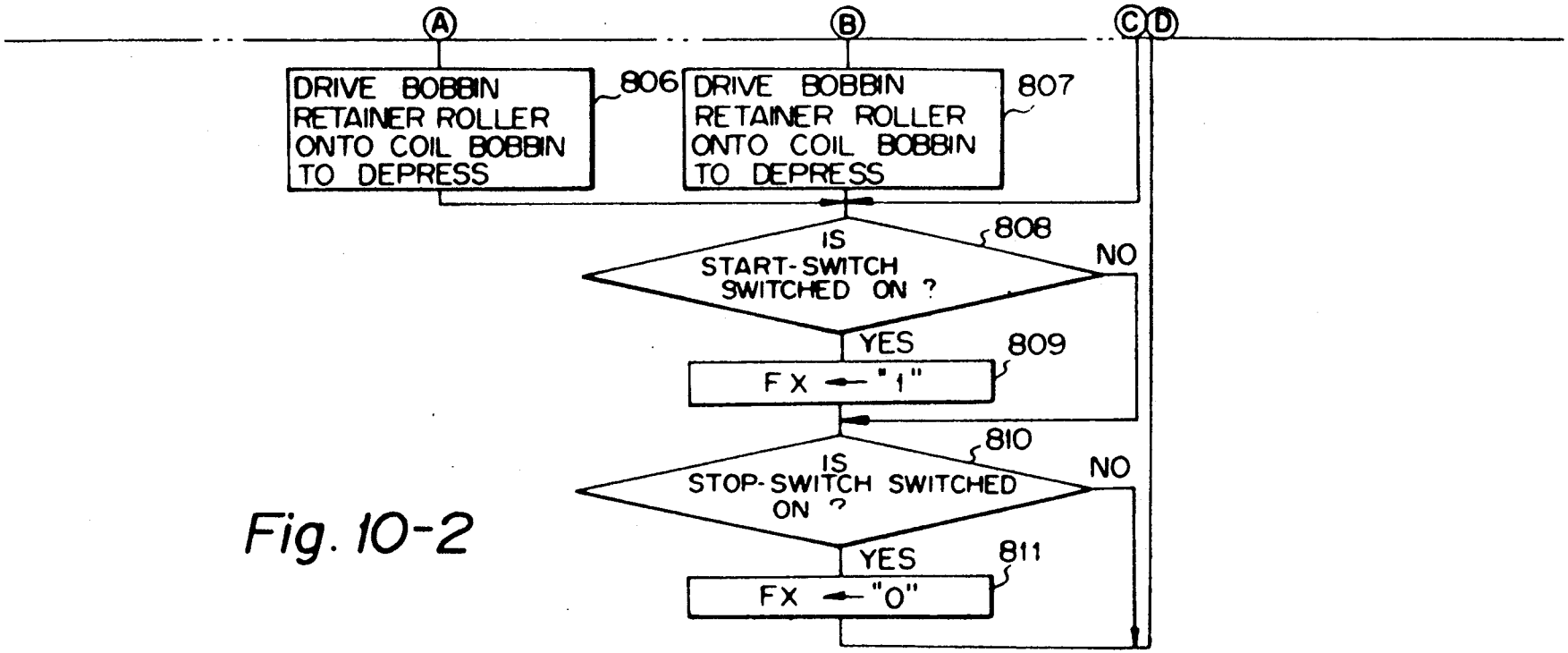

FIG. 10 (FIGS. 10-1 and 10-2) shows a main routine, which is initiated in response to turning ON a power switch (not shown). The main routine is an idle loop including an initialization routine step 801, and steps 802 to 811 for responding to various switches 12 to 15.

In the initialization routine step 801, the code number of the bobbin to be used is entered through a keyboard (not shown). Based on the entered code number, the data representative of the above-mentioned electric condition, such as number of coil, number of turns to wind for each coil, winding wire diameter (in this case, nominal wire diameter, winding start portion, winding end position, slow start winding number for winding over which winding is to be carried out at a low speed, ratio relative to the maximum speed for winding at a low speed at both ends of the coil bobbin (%), the reversal angular variation ($\Theta_{min}$) at both ends of the bobbin, the holding winding angle ($\Theta_R$), degree of slowing down at stopping, and so forth, are transferred to the RAM 105. Also, initialization (clear) of the counter C1 of the RAM and so forth. Furthermore, number n of pulses of the incremental type rotary encoder 5*a* per pulse of the stepping motor 9 is previously calculated.

At the step 802, judgement is made whether the home-switch 12 is ON or not. Only when the home-switch 12 is ON, the process is advanced to the step 803 to shift the traverse unit 8 to the winding start position by means of the stepping motor 9. When the home-switch 12 is OFF as checked at the step 802, the process is directly advanced to the step 804. In should be noted that, at the OFF position of the home-switch 12, the end of the winding wire (electric wire) 6 is engaged to the coil bobbin. On the other hand, when the traverse unit 8 is positioned at an inappropriate position, the rightward traverse switch (right-switch) 16 or the leftward traverse switch (left-switch) 17 is turned on to adjust the position of the traverse unit 8 through a routine (which is not shown).

At a step 804, a check is carried out to determine whether the press-switch 13 is ON or not. Only when the press-switch 13 is ON, the process is advanced to a step 805 to determine whether the bobbin retainer roller 3 is depressed onto the coil bobbin 1 with a predetermined pressure. Namely, the press switch 13 is used for urging the bobbin retainer roller 3 onto the coil bobbin 1 (setting) and for releasing it from the coil bobbin 1 (release). Accordingly, in response to the first switching of the press switch 13 to ON, the bobbin retainer roller 3 is depressed onto the coil bobbin 1, and in response to the second switching of the press switch 13 to ON, the bobbin retainer roller 3 is released from the coil bobbin 1. Therefore, at the step 805, if it is determined that the bobbin retainer roller 3 is not depressed onto the coil bobbin 1, the process is advanced to a step 806 to drive the bobbin retainer roller 3 onto the coil bobbin 1 to be depressed thereonto. Conversely, when it is determined that the bobbin retainer roller 3 is depressed onto the coil bobbin 1, the process is advanced to the step 807 to drive the coil retainer roller 3 away from the coil bobbin 1 to release. When the press switch 13 is OFF as checked at the step 804, the process is directly advanced to the step 808.

In the step 808, it is determined whether the start switch 14 is ON or not. Only when the start switch 14 is ON, the process is advanced to the step 809 to set a main shaft motor ON flag FX which turns the main shaft spindle motor 5 ON (FX=1). On the other hand, at a step 810, it is deternubed whether the stop switch 15 is ON or not. Only when the stop switch 15 is ON, the process is advanced to the step 811 to reset the main shaft motor ON flag FX for turning OFF the main shaft spindle motor 5 (FX=0). Subsequently, the process is returned to the step 802. Note, the main shaft spindle motor 5 is controlled corresponding to the flag FX through the routine, which will be described later.

Figure 11:
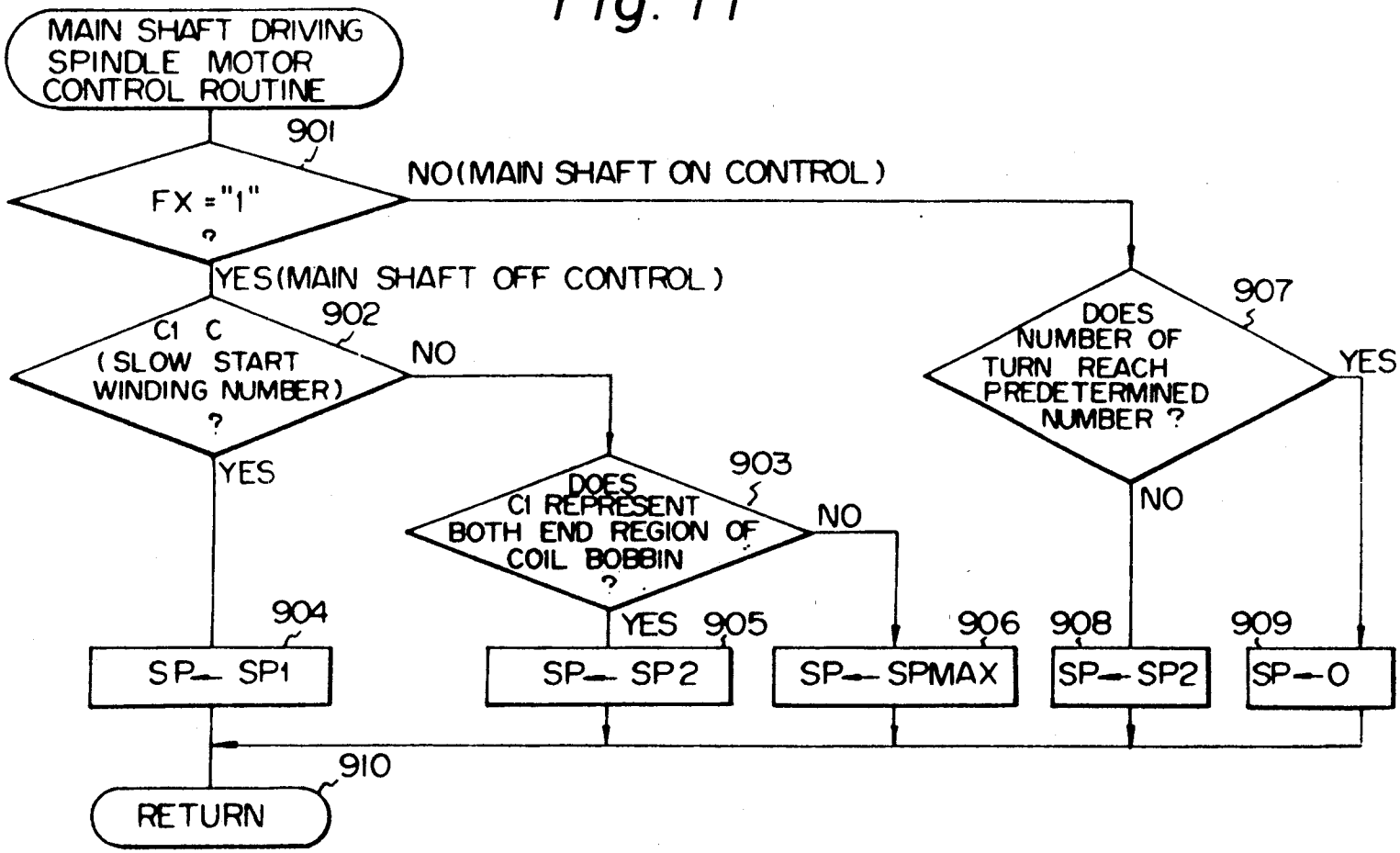

FIGS. 11 shows the routine for controlling the main shaft driving spindle motor 5, which is executed at predetermined time intervals, e.g., every four milli seconds (4 ms). At a step 901, it is determined whether the main shaft motor ON flag FX is "1" (main shaft ON control) or "0" (main shaft OFF control). When FX="1", ON control for the main shaft driving spindle motor 5 through steps 902 to 906, and when FX="0", the main shaft driving spindle motor OFF control is carried out through steps 907 to 909.

Note, at the step 902, it is determined whether the winding start position is within a slow start range (C1<C (slow start winding number) for the initial stage of winding or not based on the winding number counter C1 of the coil bobbin calculated through the routine which will be discussed later. At the step 903, it is determined whether the value of the winding number counter C1 represents both end regions of the coil bobbin 1. When C1<C (slow start winding), a slow start speed SP1 is provided to the driver circuit 111 through the D/A converter 110 as the speed SP of the main shaft driving spindle motor 5, at the step 904.

On the other hand, when the value of the winding number counter C1 represents both end regions of the coil bobbin 1, a lower speed SP2, which is a given ratio (%) to the maximum speed SPMAX, is provided for the driver circuit 111 through the D/A converter 110 as the speed SP of the main shaft driving spindle motor 5 at a step 905. When the value of the winding number counter C1 is neither the slow start range or both end regions of the coil bobbin 1, the maximum speed SPMAX is provided for the driver circuit 111 via the D/A converter 110 as the speed SP of the main shaft driving spindle motor 5, at a step 906. Note, in this case, since the maximum speed SPMAX is defined by the variable resistor 18, the command which the CPU 103 provides to the D/A converter 110, is of sufficiently greater value than the SPMAX in practice, at a step 906.

Further, in the step 907, it is determined whether the number of windings reaches the predetermined number upon turning of the main shaft and the turn ON flag FX is reset to "0". Until the number of windings reaches the predetermined number, the speed SP of the main shaft driving spindle motor 5 is set at the low speed SP2 at the step 908. When the predetermined number of turns is reached, the speed SP of the main shaft driving spindle motor 5 is set to 0 to stop the motor, at a step 909. Namely, when the main shaft motor ON flag FX is switched from "1" to "0", stopping of the main shaft driving spindle motor 5 is carried out for moderately stopping the same. Then, at the step 910, this routine is terminated.

Figure 9:
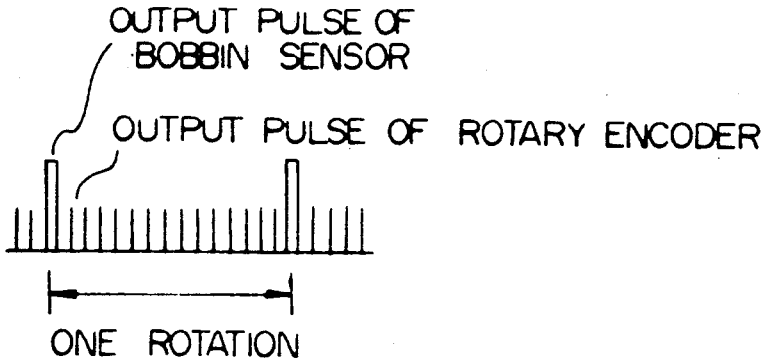
FIG. 9 is a timing chart showing an example of an output of a bobbin sensor and the output of an incremental type rotary encoder applying to the transformer coil winding apparatus of the present invention.

FIG. 9 shows an example of an output of a bobbin sensor and the output of an incremental type rotary encoder applying to the transformer coil winding apparatus of the present invention. As clearly shown in FIG. 9, when the bobbin sensor 7 and the rotary encoder 5*a* are exactly operated, the relationship between the number of the output pulse of the bobbin sensor 7 and that of the rotary encoder 5*a* is maintained at a specific constant value.

Figure 12:
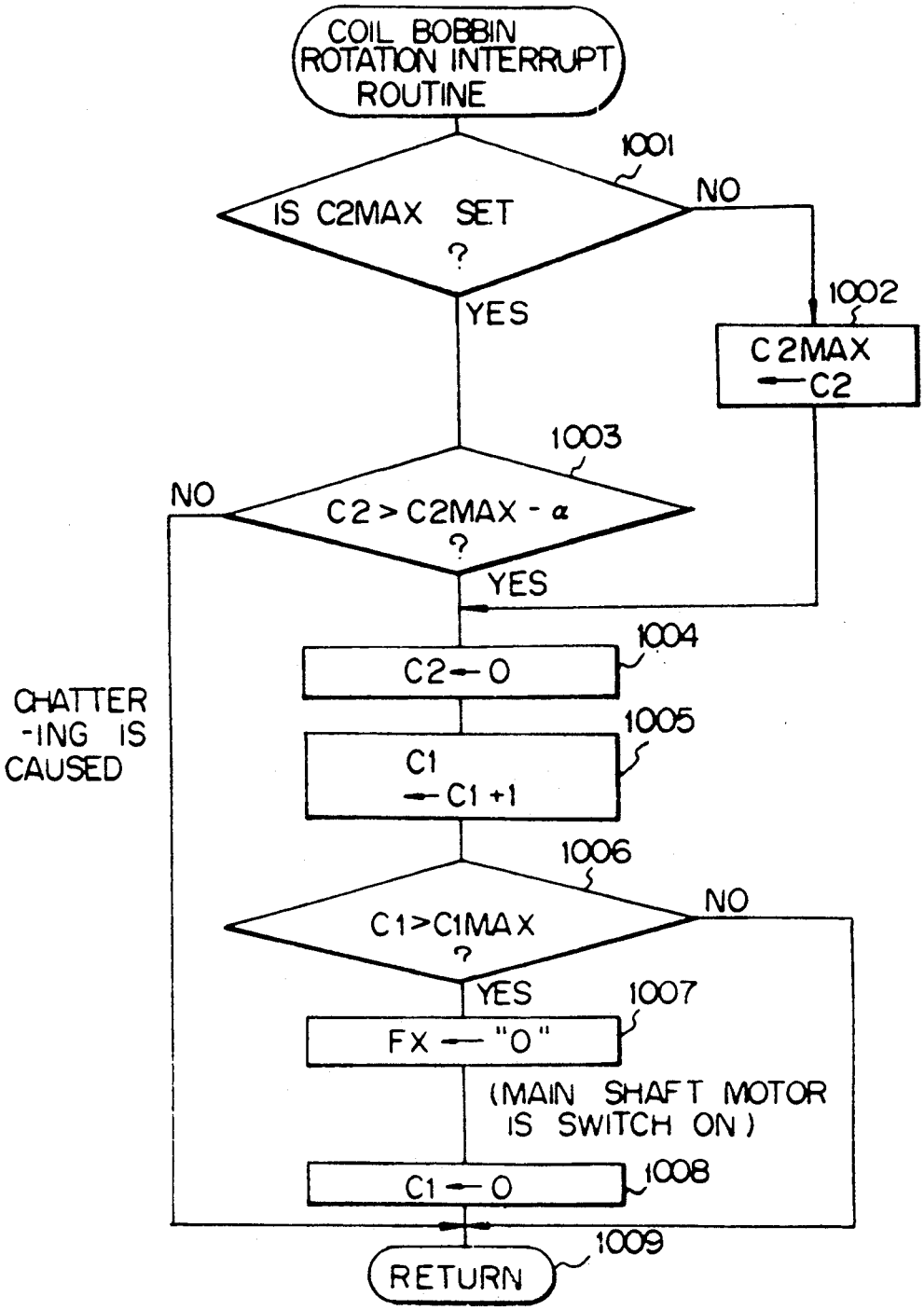

FIG. 12 shows an interrupt routine to be executed at every occurrence of an output of the bobbin sensor 7, and namely every one cycle of rotation of the coil bobbin 1. At steps 1001 and 1002, the maximum output number C2MAX of the incremental type rotary encoder 5*a* is set. Namely, at the step 1001, it is determined whether the value C2MAX has already been set or not. Only when the value C2MAX is not set, the value C2 of the counter 109 is set as the value C2MAX, at a step 1002. At a step 1003, it is determined whether the value C2 of the counter 109 is greater than a value $C2MAX-\alpha$ smaller than the above-mentioned value C2MAX, at a step 1003. When $C2<C2MAX-\alpha$ it is regarded that chattering is caused in the bobbin sensor 7. Then, the process jumps to a step 1009. It may be possible to generate an alarm at the occurrence of chattering.

At a step 1004, associated with finishing one cycle of rotation of the coil bobbin 1, the value C2 of the counter 109 is cleared. At a step 1005, the counter C1 is counted up by +1. At a step 1006, it is determined whether the value C1 reaches a bobbin stopping turn number C1MAX of the coil bobbin 1, at a step 1006. When $C1>C1MAX$, the main shaft motor ON flag FX is reset (FX=0) at a step 1007, and the counter C1 is cleared at a step 1008. It should be noted that when the main shaft motor turn ON flag FX is reset, the main shaft driving spindle motor 5 is moderately stopped through the steps 901, 907, 908 and 909 of FIG. 11. Then, the routine is terminated at a step 1009.

Figure 13:
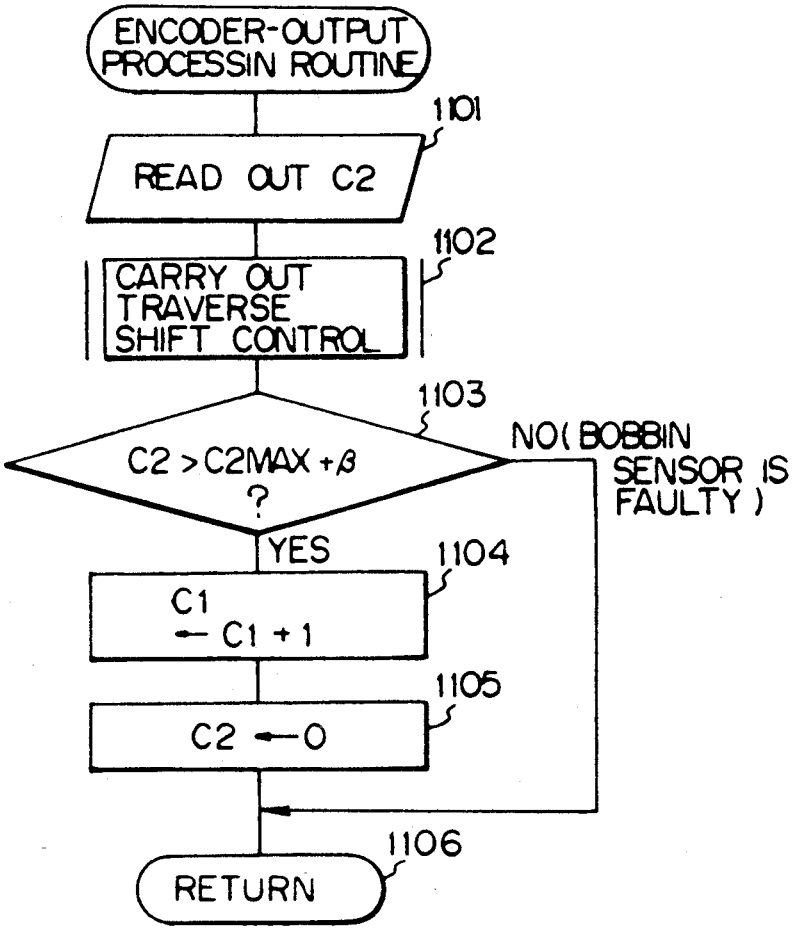

FIG. 13 shows a routine for processing the output of the encoder, namely the value C2 of the counter 109.

The shown routine is executed at every predetermined timing, e.g., every four milli seconds (4 ms). At a step 1101, the value C2 of the counter is read out. At a step 1102, the shifting of the traverse unit 8 is controlled depending upon the value C2. Further discussion for the step 1102 will be given later. Note, steps 1103 to 1105 are provided for compensating when the output of the bobbin sensor 7 is not generated due to failure. Namely, at a step 1103, when the value C2 of the counter 109 is greater than a value $C2MAX+\beta$ which is greater than the set output number C2MAX of the coil bobbin 1, it is regarded that the failure occurs on the output of the bobbin sensor 7. Then, at a step 1104, the winding counter C1 is incremented by +1, and at a step 1105, the value C2 of the counter 109 is cleared. Note, it is possible to generate an alarm at this instance. Then, the routine is terminated at a step 1106.

Figure 14:
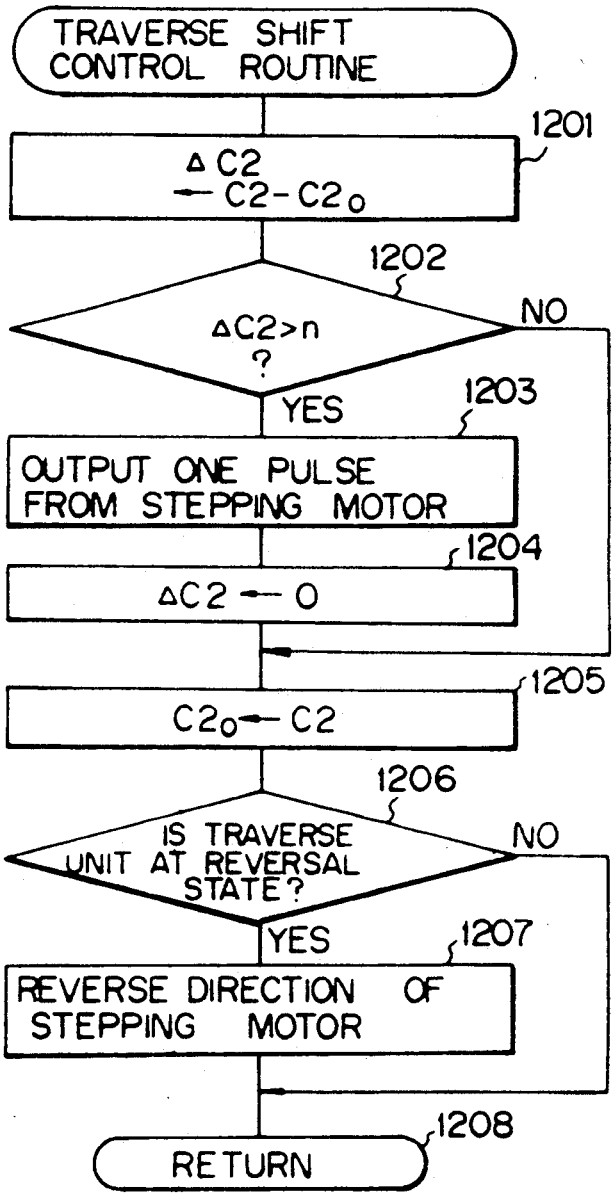

FIG. 14 shows a detailed routine of the traverse shift control step 1102 of FIG. 13. Namely, at a step 1201, the increment value C2 of the output number C2 of the encoder is calculated by: $\Delta C2 \leftarrow C2-C2_0$; where, $C2_0$ is the immediately preceding value of the value C2. At a step 1202, it is determined whether the increment value $\Delta C2$ is greater than the pulse number n which has been previously calculated in the initialization routine step 801 of FIG. 10 (FIG. 10-1).

Only when $C2>n$, one pulse is output from the stepping motor 9 at a step 1203. Then, at a step 1204, the increment value $\Delta C2$ is cleared for the next execution cycle.

Further, at a step 1205, for preparation of the next execution, the value of the counter C2 is set as the preceding cycle value $C2_0$. At a step 1206, it is determined whether the traverse unit 8 is to be reversed, namely whether the driving direction of the stepping motor 9 is to be reversed, or not, by checking whether the value C1 of the winding counter C1 reaches the reversal value or not. Only when the judgement is made that the traverse unit is to be reversed, the process is advanced to a step 1207 to reverse the revolution direction of the stepping motor 5*a*. Then, the routine is terminated at a step 1208.

Figure 15:
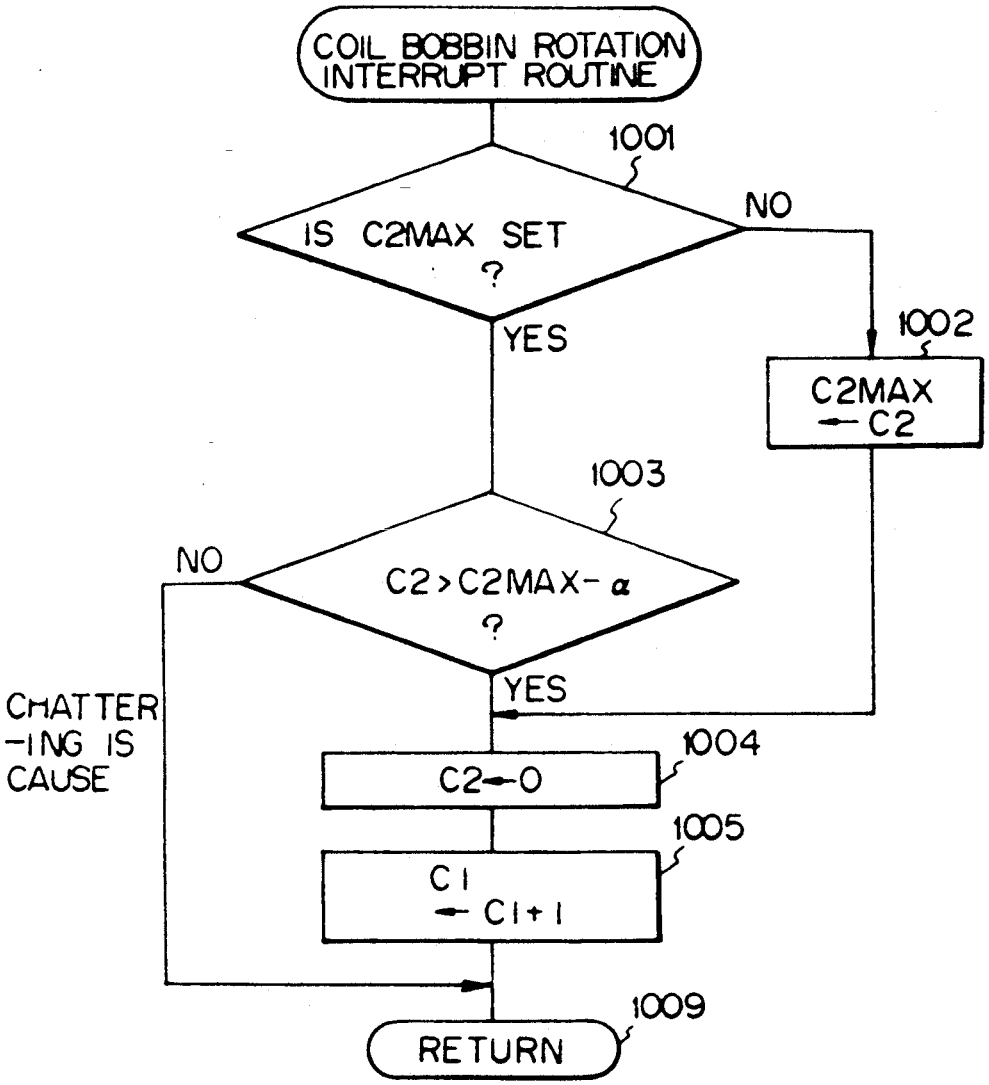
Figure 16:
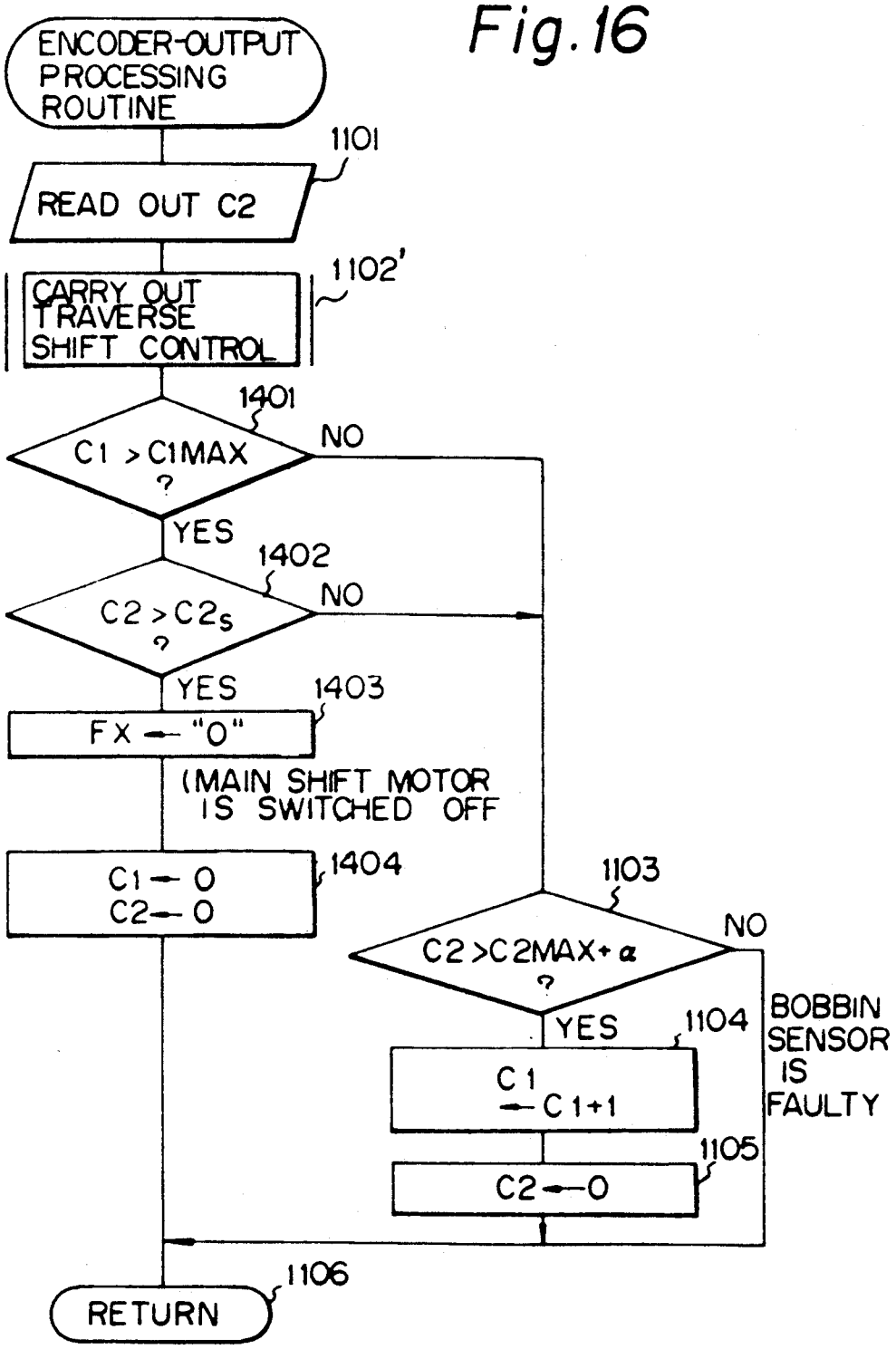
Figure 17:
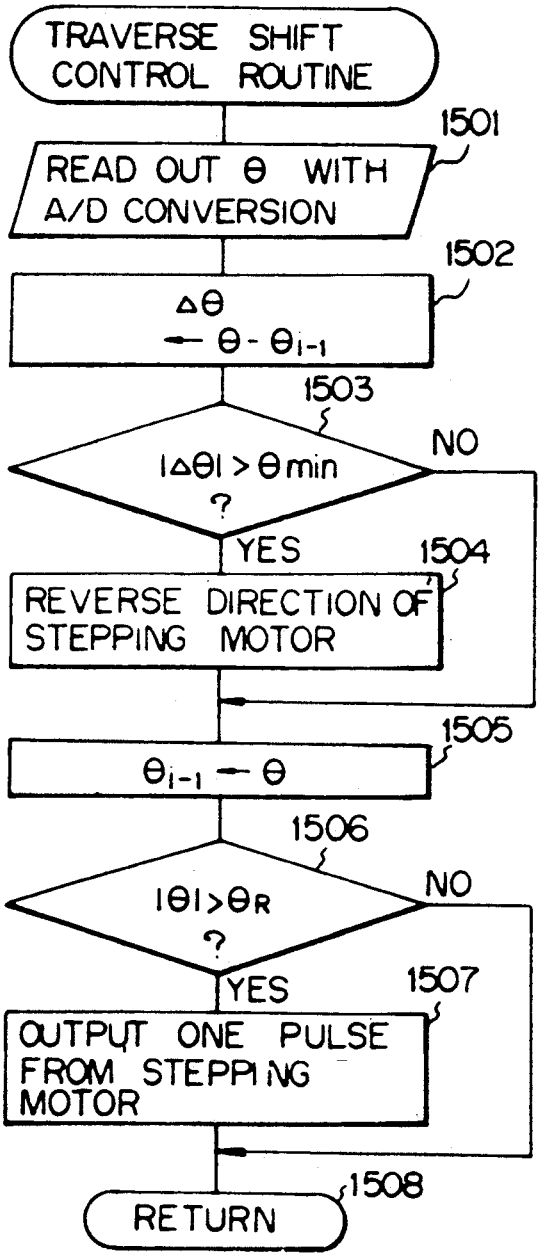

Next, the modified embodiments of FIGS. 12 to 14 will be explained with reference to FIGS. 15 to 17. FIGS. 15 to 17 show the condition in which the winding start position and the winding end position on the coil bobbin 1 are different, namely, a difference is present between the winding start position and the winding end position. In this case, the OFF control of the main shaft driving spindle motor 5 is defined by the value C1MAX of the winding number counter C1 and the value C2s of the counter 109. Accordingly, in the routine of FIG. 15, the steps 1006 to 1008 of FIG. 12 are not provided, and instead, the steps 1401 to 1404 of FIG. 16 are provided. Also, the traverse shift control step 1102' is differentiated from the traverse shift control step 1102 of FIG. 13, accordingly, the routines of FIGS. 14 and 17 are differentiated from each other.

At the step 1401, a check is carried out to determine whether the winding number counter C1 reaches the predetermined value C1MAX. At a step 1420, a check is carried out whether the output number C2 of the encoder reaches the predetermined value C2s. Only when $C1>C1MAX$ and $C2>C2s$, the main shaft motor ON flag FX is reset (FX="0") to perform the OFF control routine of FIG. 11 for the main shaft driving spindle motor 5.

FIG. 17 shows the flowchart showing a detailed process of the traverse shift controlling state 1102' of FIG. 16. The traverse shift control is carried out employing the routine of FIG. 17 instead of the routine of FIG. 14.

At a step 1510 of FIG. 17, the winding angle $\Theta$ of the winding angle sensor 83 is read out through the A/D converter. Then, at a step 1502, the variation magnitude $\Delta\Theta$ of the winding angle $\Theta$ is calculated by: $\Delta\Theta \leftarrow \Theta - \Theta_{i-1}$; where $\Theta_{i-1}$ is the immediately preceding value of the winding angle $\Theta$.

At a step 1503, it is determined whether the absolute value $|\Theta|$ of the variation magnitude $\Delta\Theta$ of the winding angle $\Theta$ is greater than a reversal angle variation magnitude $\Theta_{min}$. Namely, judgement for the abrupt variation of the winding angle $\Theta$ is carried out. By this, it can be determined whether the winding wire 6 comes into contact with one of the flanges of the coil bobbin 1. Only when the abrupt variation of the winding angle $\Theta$ is detected, the process is advanced to a step 1504 to cause a reversal of the revolution direction of the stepping motor 9, and accordingly reverse the traverse unit 8.

At steps 1506 and 1507, the steady state operation of the stepping motor 9 is carried out. namely, at the step 1506, it is determined whether the absolute value $|\Theta|$ of the winding angle $\Theta$ is greater than a holding winding angle $\Theta_R$. Only when $|\Theta| > \Theta_R$, one pulse is output to the stepping motor 9. Therefore, the winding angle $\Theta$ becomes approximately equal to $\Theta_R$. At a step 1508, the shown routine is terminated.

The steps 1506 and 1507 can perform a reversal of traverse shift in a relatively more stable state than the steps 1206 and 1207 of FIG. 14, because the reversal of traverse in the steps 1206 and 1207 depend upon the diameter of the winding wire. Note, although the traverse shifting in the step 1503 of FIG. 17 is in response to abrupt variation of the winding angle $\Theta$, it is possible to add a condition to determine whether the winding number reaches a value slightly smaller than the winding counter value C1 at the reversal.

In the above described embodiments of the transformer coil winding apparatus according to the present invention, the increment type rotary encoder is employed, however, it is possible to employ an absolute type rotary encoder. In this case, the counter 109 of FIG. 4 becomes unnecessary and the output per se of the rotary encoder represents the value C2 (only for specific code).

As described above, according to the present invention, the coil bobbin production cost can be lowered by employment of the frictional rotation mechanism. Also, it makes it possible to perform a coil winding operation at high speed to contribute to mass production. Therefore, the production cost for the transformer can be lowered. Further, the traverse shift can be done stably, and it allows for the stable reversal of a traverse shift.

Many different embodiments of the present invention may be constructed without departing from the spirit and scope of the present invention, and it should be understood that the present invention is not limited to the specific embodiments described in this specification, except as defined in the appended claims.

I claim:

1. A transformer coil winding apparatus for winding a winding wire on a coil bobbin comprising:

a rotating drive mechanism for rotatably driving said coil bobbin by a friction force between said coil bobbin and said rotating drive mechanism;

a detection means provided on said coil bobbin;

a rotation number counting means for counting the number of rotations of said coil bobbin on the basis of the output of said detection means;

a winding traversing means for maintaining a winding angle of said winding wire at a predetermined value in response to the number of rotations on said rotation number counting means; and said winding traversing means comprising a winding angle sensor for detecting said winding angle of said winding wire, and a winding traverse shifting means for maintaining said detected winding angle to a predetermined value;

a winding angle abrupt variation judgment means for judgment of abrupt variation of the detected winding angle; and a reversing means for reversing said winding angle by said winding traverse shifting means when said detected winding angle is abruptly varied.

2. A transformer coil winding apparatus for winding a winding wire on a coil bobbin comprising:

a rotating drive mechanism for rotatably driving said coil bobbin by a friction force between said coil bobbin and said rotating drive mechanism;

a detection means provided on said coil bobbin;

a rotation number counting means for counting the number of rotations of said coil bobbin on the basis of the output of said detection means;

a rotary encoder provided on a drive shaft of said rotating drive mechanism; and a drive means for rotatably driving said rotating drive mechanism in response to the number of rotations on said rotation number counting means and the output of said rotary encoder.

3. A transformer coil winding apparatus as claimed in claim 2, wherein said transformer coil winding apparatus further comprises:

a memory means for storing a number of outputs per one cycle of said rotary encoder in a detection period for detecting one cycle of said coil bobbin by said rotation number counting means; and inhibiting means for inhibiting incrementing of rotations on said rotation number counting means when the number of outputs or output value of said rotary encoder upon reception of the output signal of said detection means is a value smaller than the output number or the output value per one cycle.

4. A transformer coil winding apparatus as claimed in claim 2, wherein said transformer coil winding apparatus further comprises:

a memory means for storing a number of outputs per one cycle of said rotary encoder in a detection period for detecting one cycle of the coil bobbin by said rotation number counting means; and rotation number correction means for incrementing of rotations on said rotation number counting means by one when the number of outputs or output value of said rotary encoder upon reception of the output signal of said detection means is a value greater than the output number or the output value per one cycle.

5. A transformer coil winding apparatus for winding a winding wire on a coil bobbin comprising:

a rotating drive mechanism for rotatably driving said coil bobbin by a friction force between said coil bobbin and said rotating drive mechanism;

a detection means provided on said coil bobbin;

a rotation number counting means for counting the number of rotations of said coil bobbin on the basis of the output of said detection means;

a rotary encoder provided on a drive shaft of said rotating drive mechanism; and a winding traversing means for maintaining a winding angle of said winding wire at a predetermined value in response to the number of rotations on said rotation number counting means and the output of said rotary encoder.

6. A transformer coil winding apparatus as claimed in claim 5, wherein said winding traversing means comprises:

a winding angle sensor for detecting said winding angle of said winding wire; and a winding traverse shifting means for maintaining said detected winding angle to a predetermined value.

7. A transformer coil winding apparatus as claimed in claim 6, wherein said transformer coil winding apparatus includes:

a winding angle abrupt variation judgement means for judgement of abrupt variation of the detected winding angle; and a reversing means for reversing said winding angle by said winding traverse shifting means when said detected winding angle is abruptly varied.

8. A transformer coil winding apparatus for winding a winding wire on a coil bobbin comprising:

a detection means provided on said coil bobbin;

a rotation number counting means for counting the number of rotations of said coil bobbin on the basis of the output of said detection means;

a winding traversing means for maintaining a winding angle of said winding wire at a predetermined value in response to the number of rotations on said rotation number counting means; and said winding traversing means comprising a winding angle sensor for detecting said winding angle of said winding wire, and a winding traverse shifting means for maintaining said detected winding angle to a predetermined value;

a winding angle abrupt variation judgment means for judgment of abrupt variation of the detected winding angle; and a reversing means for reversing said winding angle by said winding traverse shifting means when said detected winding angle is abruptly varied.

9. A transformer coil winding apparatus for winding a winding wire on a coil bobbin comprising:

a detection means provided on said coil bobbin;

a rotation number counting means for counting the number of rotations of said coil bobbin on the basis of the output of said detection means;

a rotary encoder provided on a drive shaft of said rotating drive mechanism; and a drive means for rotatably driving said rotating drive mechanism in response to the number of rotations on said rotation number counting means and the output of said rotary encoder.

10. A transformer coil winding apparatus as claimed in claim 9, wherein said transformer coil winding apparatus further comprises:

a memory means for storing a number of outputs per one cycle of said rotary encoder in a detection period for detecting one cycle of said coil bobbin by said rotation number counting means; and inhibiting means for inhibiting incrementing of rotations on said rotation number counting means when the number of outputs or output value of said rotary encoder upon reception of the output signal of said detection means is a value smaller than the output number or the output value per one cycle.

11. A transformer coil winding apparatus as claimed in claim 9, wherein said transformer coil winding apparatus further comprises:

a memory means for storing a number of outputs per one cycle of said rotary encoder in a detection period for detecting one cycle of the coil bobbin by said rotation number counting means; and rotation number correction means for incrementing of rotations on said rotation number counting means by one when the number of outputs or output value of said rotary encoder upon reception of the output signal of said detection means is a value greater than the output number or the output value per one cycle.

12. A transformer coil winding apparatus for winding a winding wire on a coil bobbin comprising:

a detection means provided on said coil bobbin;

a rotation number counting means for counting the number of rotations of said coil bobbin on the basis of the output of said detection means;

a rotary encoder provided on a drive shaft of said rotating drive mechanism; and a winding traversing means for maintaining a winding angle of said winding wire at a predetermined value in response to the number of rotations on said rotation number counting means and the output of said rotary encoder.

13. A transformer coil winding apparatus as claimed in claim 12, wherein said winding traversing means comprises:

a winding angle sensor for detecting said winding angle of said winding wire; and a winding traverse shifting means for maintaining said detected winding angle to a predetermined value.

14. A transformer coil winding apparatus as claimed in claim 13, wherein said transformer coil winding apparatus includes:

a winding angle abrupt variation judgement means for judgement of abrupt variation of the detected winding angle; and a reversing means for reversing said winding angle by said winding traverse shifting means when said detected winding angle is abruptly varied.

15. An apparatus having a coil bobbin for a transformer where a winding wire is wound by using a transformer coil winding apparatus with means for rotatably driving said coil bobbin by a friction force between said coil bobbin and a rotating drive mechanism of said transformer coil winding apparatus, wherein said apparatus comprises:

the coil bobbin having two flanges; and a detection means including a rotation number counting means for counting the number of rotations of said coil bobbin, said coil bobbin being rotatably driven by said rotating drive mechanism in response to the number of rotations on said rotation number counting means, and said detection means comprising at lease one optical mark provided on one of said flanges of said coil bobbin and an optical sensor for detecting said optical mark by one cycle of rotation of said coil bobbin.

16. An apparatus as claimed in claim 13, wherein said at least one optical mark has a different light reflection factor from another area of said flange where said optical mark is not provided, and said optical sensor detects the light intensity reflected from said optical mark.

17. An apparatus as claimed in claim 15, wherein said at least one optical mark has a specific color different from another area of said flange where said optical mark is not provided, and said optical sensor detects the color of said optical mark.

18. An apparatus having a coil bobbin for a transformer where a winding wire is wound by using a transformer coil winding apparatus with means for rotatably driving said coil bobbin by a friction force between said coil bobbin and a rotating drive mechanism of said transformer coil winding apparatus, wherein said apparatus comprises:

the coil bobbin having two flanges made of dielectric material; and a detection means for including a rotation number counting means counting the number of rotations of said coil bobbin, said coil bobbin being rotatably driven by said rotating drive mechanism in response to the number of rotations on said rotation number counting means, and said detection means comprises at lease one metal mark provided on one of said flanges of said coil bobbin and a metal sensor for detecting said metal mark by one cycle of rotation of said coil bobbin.

19. An apparatus as claimed in claim 18, wherein said metal sensor comprises a magnet sensor.

20. A transformer coil winding apparatus for winding a winding wire on a coil bobbin comprising a rotating drive mechanism for rotatably driving said coil bobbin by a friction force between said coil bobbin and said rotating drive mechanism, wherein said rotating drive mechanism comprises two pairs of bobbin drive rollers, a pair of bobbin retainer rollers, and a retainer roller moving means for moving said bobbin retainer rollers in up and down directions.

21. A transformer coil winding apparatus as claimed in claim 20, wherein said retainer roller moving means comprises a pneumatic cylinder.

22. A transformer coil winding apparatus as claimed in claim 21, wherein said friction force is generated between said coil bobbin and said bobbin drive rollers by the pressure of said pneumatic cylinder, when said bobbin retainer rollers are lowered.

23. A transformer coil winding apparatus as claimed in claim 20, wherein said friction force is generated between said coil bobbin and said bobbin drive rollers by the pressure of said retainer roller moving means, when said bobbin retainer rollers are lowered.

24. A transformer coil winding apparatus for winding a winding wire on a coil bobbin comprising a rotating drive mechanism for rotatably driving said coil bobbin by a friction force between said coil bobbin and said rotating drive mechanism, wherein said rotating drive mechanism comprises two pairs of bobbin drive rollers, a pair of bobbin retainer rollers, a pair of holding rollers for decreasing the shake of said coil bobbin in the shaft direction thereof and rotatably holding said coil bobbin, and a retainer roller moving means for moving said bobbin retainer rollers in up and down directions.

25. A transformer coil winding apparatus as claimed in claim 24, wherein said retainer roller moving means comprises a pneumatic cylinder.

26. A transformer coil winding apparatus as claimed in claim 25, wherein said friction force is generated between said coil bobbin and said bobbin drive rollers by the pressure of said pneumatic cylinder, when said bobbin retainer rollers are lowered.

27. A transformer coil winding apparatus as claimed in claim 24, wherein said friction force is generated between said coil bobbin and said bobbin drive rollers by the pressure of said retainer roller moving means, when said bobbin retainer rollers are lowered.

* * * * *